US007806164B2

(12) United States Patent
Morales et al.

(10) Patent No.: US 7,806,164 B2
(45) Date of Patent: Oct. 5, 2010

(54) METHOD AND SYSTEM FOR TRACKING AND POSITIONING CONTINUOUS CAST SLABS

(75) Inventors: Darrell Morales, Dyersburg, TN (US); Kevin Evans, Dyersburg, TN (US)

(73) Assignee: Nucor Corporation, Charlotte, NC (US)

( * ) Notice: Subject to any disclaimer, the term of this patent is extended or adjusted under 35 U.S.C. 154(b) by 583 days.

(21) Appl. No.: 11/740,537

(22) Filed: Apr. 26, 2007

(65) Prior Publication Data

US 2008/0264598 A1 Oct. 30, 2008

(51) Int. Cl.
*B22D 11/20* (2006.01)
*B22D 11/128* (2006.01)
*B22D 11/14* (2006.01)

(52) U.S. Cl. ..... 164/454; 164/154.5; 164/484; 164/413

(58) Field of Classification Search ..... 164/452, 164/454, 484, 413, 151.2, 154.2, 154.5
See application file for complete search history.

(56) References Cited

U.S. PATENT DOCUMENTS 4,940,076 A * 7/1990 Desautels et al. ..... 164/452
6,129,136 A * 10/2000 Tibbs et al. ..... 164/454
6,332,492 B1 * 12/2001 Donini et al. ..... 164/476
6,533,023 B2 3/2003 Fukase et al.
6,766,934 B2 7/2004 Ziegelaar et al.
2006/0156778 A1 7/2006 Ondrovic et al.
2006/0207744 A1 9/2006 Ondrovic et al.

FOREIGN PATENT DOCUMENTS

EP 0 397 123 A2 11/1990
KR 20030022622 A 3/2003

OTHER PUBLICATIONS

PCT/US2008/061124 International Search Report.
PCT/US2008/061124 Written Opinion.

* cited by examiner

*Primary Examiner*—Kevin P Kerns
(74) *Attorney, Agent, or Firm*—Hahn, Loeser & Parks, LLP; Arland T. Stein

(57) ABSTRACT

A system and method for tracking and positioning a continuous cast strand in a casting plant. Lateral positions and, optionally, elevational positions of a cast strand are monitored by sensors as casting proceeds and are fed to a computer-based system as corresponding position information where the information is stored as associated data. The computer-based system processes the associated data and generates corresponding control signals which are used to control at least one correcting device to maintain desired orientation of the cast strand as casting proceeds.

42 Claims, 9 Drawing Sheets

METHOD AND SYSTEM FOR TRACKING AND POSITIONING CONTINUOUS CAST SLABS

BACKGROUND AND SUMMARY

Continuous slab casting is a steel making process where molten (liquid) steel from a ladle is continuously cast into cast metal strand of a semi-finished shape (e.g., slabs, blooms, and billets). In a continuous slab caster, the molten metal is fed by gravity from the ladle through a tundish to a subentry nozzle (SEN) in a casting mold. The semi-finished shape is determined by the casting mold which receives the molten steel through the SEN. The steel is cast in the casting mold, which is water cooled, with a solidified outer shell and molten inner core as the strand moves downwardly through the mold which oscillates. The cast metal strand is withdrawn downwardly from the casting mold and is curved by casting guide rollers and straighteners to exit the casting machine laterally in a horizontal direction of travel. The strand is further subjected to secondary cooling upon exiting from the casting machine by direct and/or secondary cooling to solidified the core of the strand. The strand is then cut to length into slabs, blooms, or billets.

In the continuous caster, the SEN discharges the molten metal into the mold at a selected depth below the surface (the meniscus) of the melt in the casting mold. The flow of the molten melt from the tundish is fed by the ferrostatic pressure difference between the liquid levels in the tundish and that of the melt in the casting mold. The melt flow from the tundish may be controlled by a stopper rod, which at least partially blocks the exit port to a shroud leading to the SEN, or a slide gate that moves across the outlet port of the tundish to the shroud. As the molten metal enters the mold, the steel solidifies at the water cooled mold walls to form an outer shell, which is continuously withdrawn at the casting speed to produce the steel strand by oscillation of the mold walls. The rate of formation of the cast metal strand by the casting machine is substantially equal to the rate of flow of the molten steel through the SEN into the casting mold.

The width of the steel strand exiting the mold is determined substantially by the relative separation and taper angle of opposing faces of the casting mold. The molten steel tends to shrink in the mold (i.e., pull away from the mold faces) as it cools and moves from the top of the mold (e.g., adjacent the SEN) to the bottom of the mold. The mold faces are tapered to account for the shrinkage, so that the molten steel moving through the mold may maintain contact with the mold faces.

As the strand exits downwardly from the casting mold, the strand enters containment segments which serve to further cool and solidify the strand. The rolls of containment segments may also apply pressure to the strand to reduce the thickness of the strand. As the strand exits the containment segments, the strand may enter a set of pinch rolls which serve to feed the hot metal strand downward from the mold and toward a withdrawal straightener. A disconnect roll positioned below the set of pinch rolls may be provided to initially direct the cast metal strand toward the withdrawal straightener and to disconnect a starter dummy bar from the cast metal strand. The dummy bar allows the start of casting by providing a surface onto which to cast the strand at the start of the cast.

The cast metal strand enters the withdrawal straightener which serves to transition the strand laterally to a horizontal direction of travel. The withdrawal straightener provides support for the hot metal strand as the strand cools and progresses at casting speed through the withdrawal straightener and toward a cutting tool which is external to the withdrawal straightener. The withdrawal straightener includes drives to move the cast metal strand through the withdrawal straightener as casting proceeds.

By the time the cast metal strand exits the withdrawal straightener and enters the cutting tool, the cast metal strand is generally solid and significantly cooled such that the strand is ready to be cut (i.e., transverse to the direction of travel of the strand) to form a cast shape such as slabs, blooms, or billets. The cutting tool may comprise a shear having, for example, cutting blades. For thicker strands, a cutting torch, or other cutting mechanism suitable to cut the cast metal strand laterally may be used. As the strand is cut into slabs, for example, the slabs are generally transported away on rollers to be further processed.

As the cast metal strand travels from the casting mold through the casting machine and beyond to the cutting tool, the strand may tend to wander, distort, and twist due to forces exerted on the strand. Such forces may be due to cooling of the strand, or forces exerted by the pinch rolls or withdrawal straightener. It is desirable to keep the cast metal strand positioned substantially orthogonal to the direction of travel for the casting machine to work effectively and produce quality strands at commercial casting speeds.

Methods are disclosed for continuously casting metal strand and for monitoring and controlling a cast metal strand in a continuous metal slab caster comprising the steps of:

- monitoring a first lateral position of a cast metal strand adjacent entry to a withdrawal straightener,
- monitoring a second lateral position of the cast metal strand adjacent exit from the withdrawal straightener,
- monitoring a third lateral position of the cast metal strand downstream of a cutting tool, and
- electronically storing the monitored lateral positions as associated data in a computer-based system and using the associated data to actuate at least one correcting device capable of adjusting the orientation of the strand during casting.

The methods may further include monitoring an elevation position of the cast metal strand adjacent the withdrawal straightener and optionally adjacent a set of pinch rolls, and electronically storing the monitored elevation position in the computer-based system as a part of the associated data. In an embodiment, monitoring of the elevation position may be accomplished by detecting an elevation location of a first broad side of the metal cast strand. Monitoring of each of the first, second and third lateral positions may also be accomplished by detecting a first lateral location of a first narrow side of the cast metal strand and a second lateral location of a second opposite narrow side of the cast metal strand. The detecting may be accomplished using a laser sensor capable of detecting the monitored elevation position and using pairs of laser sensors capable of detecting the opposite sides of each lateral positions monitored.

The stored associated data is processed by the computer-based system to generate at least one control signal such as, for example, a feed-forward control signal and a feedback control signal. The control signals are used to control one or more correcting devices, such as mold taper of a casting mold, roll force or pressure profile of the rolls of the withdrawal straightener, tilt of the withdrawal straightener, tilt of the set of pinch rolls, cooling sprays operating on rolls adjacent the slab caster, drive speed of the set of pinch rolls, and drive speed of the withdrawal straightener.

Also, a continuous slab caster and a system for a continuous metal slab caster are disclosed comprising:

a first pair of position-detecting sensors positioned laterally with respect to a direction of travel of the cast metal strand adjacent entry to the withdrawal straightener, a second pair of position-detecting sensors positioned laterally with respect to a direction of travel of the cast metal strand adjacent exit from a withdrawal straightener, a third pair of position-detecting sensors positioned laterally with respect to a direction of travel of the cast metal strand downstream of a cutting tool, and a computer-based apparatus electrically connected to the first pair, second pair and third pair of position-detecting sensors and controlling at least one correcting device capable of adjusting the orientation of the strand during casting.

The slab caster and the system may further comprise a fourth position-detecting sensor positioned to detect the strand substantially orthogonal along a direction of travel of the cast metal strand adjacent the withdrawal straightener and optionally adjacent a set of pinch rolls. If used, the fourth position-detecting sensor is electronically connected to the computer-based apparatus. In an embodiment, the sensors may include laser devices and the computer-based apparatus may include a programmable logic controller (PLC) capable of being programmed with automation software. The computer-based apparatus may be capable of receiving a position signal, corresponding to a detected position of the cast metal strand from at least one of the sensors, and generating at least one control signal in response to the position signal such as, for example, a feed-forward control signal and/or a feedback control signal.

The control signals from the computer-based apparatus may be used to control a desired correcting device, such as a mold taper of a casting mold of the slab caster. U.S. patent application Ser. No. 11/627,511 filed on Jan. 26, 2007 is incorporated herein by reference in its entirety, and describes methods and devices for controlling mold face position in a continuous slab caster. Alternatively or in addition, the control signals from the computer-based apparatus may be used to control roll force or pressure profile of the withdrawal straightener, tilt of the withdrawal straightener, tilt of a set of pinch rolls, cooling spray onto rolls adjacent the slab caster, drive speed of a set of pinch rolls, and drive speed of the withdrawal straightener. In an embodiment, the computer-based apparatus further may include a database management system (DBMS) electrically interfacing to the programmable logic controller (PLC) and capable of storing position data received from the programmable logic controller (PLC), and where the position data is generated by the programmable logic controller (PLC) from the position signals received from the sensors.

A method for continuously casting steel slabs is also disclosed comprising the steps of:

assembling a continuous metal slab caster having a vertically-oriented casting mold, a withdrawal straightener positioned downstream of the casting mold, and a cutting tool positioned downstream of the withdrawal straightener, assembling a first pair of position-detecting sensors adjacent entry to the withdrawal straightener and positioned to detect substantially laterally with respect to a direction of casting, assembling a second pair of position-detecting sensors adjacent exit from the withdrawal straightener and positioned to detect substantially laterally with respect to the direction of casting, assembling a third pair of position-detecting sensors adjacent exit from the cutting tool and positioned to detect substantially laterally with respect to the direction of casting, assembling a computer-based system electrically connected to the sensors, introducing molten metal into the casting mold and casting a metal strand downwardly from the casting mold, through the withdrawal straightener, and through the cutting tool, monitoring substantially lateral positions of the cast strand using the first, second, and third pairs of sensors as casting proceeds, and electronically storing the monitored positions as associated data in the computer-based system and using the associated data to actuate at least one correcting device capable of adjusting the orientation of the strand during casting.

The associated data may then be processed using the computer-based system to generate at least one control signal (e.g., a feed-forward control signal and/or a feedback control signal). The control signals may be used to control the correcting device, which may be one or more of a mold taper of the casting mold, roll force or pressure profile of the withdrawal straightener, tilt of the withdrawal straightener, tilt of a set of pinch rolls, cooling spray onto rolls or strand adjacent the slab caster, drive speed of a set of pinch rolls, and drive speed of the withdrawal straightener.

As an option, a fourth position-detecting sensor may be assembled adjacent the withdrawal straightener, and optionally adjacent at least one set of pinch rolls, to detect the elevation of the strand along the direction of travel of the cast metal strand. The fourth position-detecting sensor may monitor an elevation position of the cast strand by detecting an elevation location of a first broad side of the cast strand as casting proceeds. The fourth position-detecting sensor detects the position of the cast strand substantially orthogonally to the position of the strand detected by the first, second and third lateral position-detecting sensors.

Monitoring of each of the first, second and third lateral positions may be accomplished by detecting a first lateral location of a first narrow side of the cast metal strand and a second lateral location of a second opposite narrow side of the cast metal strand. Again, in an embodiment the position-detecting sensors may comprise laser-based sensors, but, other types of position-detecting sensors may be used as desired in a particular embodiment.

Additionally, a slab caster plant is disclosed for producing continuously cast slabs with improved quality by monitoring and controlled positioning. The slab caster plant comprises:

(a) a vertically-oriented casting mold, (b) optionally, a set of pinch rolls positioned downstream of the casting mold, (c) a withdrawal straightener positioned downstream of casting mold, and if present, the set of pinch rolls, (d) a cutting tool positioned downstream of the withdrawal straightener, (e) a first pair of position-detecting sensors positioned adjacent entry to the withdrawal straightener and arranged to detect substantially laterally with respect to a direction of casting, (f) a second pair of position-detecting sensors positioned adjacent exit from the withdrawal straightener and arranged to detect substantially laterally with respect to the direction of casting, (g) a third pair of position-detecting sensors positioned adjacent exit from the cutting tool and arranged to detect substantially laterally with respect to the direction of casting, and (h) a computer-based system electrically connected to each of the first, second and third position-detecting sensors and capable of controlling at least one correction device to modify orientation of the cast strand along the direction of travel.

In an embodiment, the position-detecting sensors comprise laser-based sensors, or other type of position-detecting sensor in accordance with the desired embodiment.

As an option, the caster plant may further include a fourth position-detecting sensor positioned adjacent the withdrawal straightener and optionally a set of pinch rolls. The fourth position-detecting sensor is positioned to detect the position of the cast strand along the direction of travel through the slab caster plant substantially orthogonal to the position of the strand detected by at least one of the first pair, second pair or third pair of sensors.

The computer-based platform may include a programmable logic controller (PLC) and a database management system (DBMS). The PLC may be capable of being programmed with automation software and of receiving information (data/signals) indicating the detected position of a cast metal strand traveling through the caster plant at at least one of the first pair, second pair or third pair sensors, and generating at least one control signal such as, for example, a feed-forward control signal and/or a feedback control signal in response to the information. Furthermore, the PLC may be capable of receiving information (data/signals) indicating a detected position of a cast metal strand traveling through the caster plant from at least one of the first pair, second pair or third pair sensors, and transmitting the information to the DBMS. The DBMS is capable of storing the information and associating the information with other information received from other sensors. Also, the PLC is capable of receiving data, corresponding to a detected position of a cast metal strand traveling through the caster plant of at least one of the first pair, second pair or third pair from the DBMS, and processing the data to generate at least one control signal such as, for example, a feed-forward control signal and/or a feedback control signal.

The control signals may be used to control a correcting device capable of adjusting the orientation of the strand during casting. This adjustment in orientation is lateral to the direction of travel, but may also be elevational to the direction of travel of the cast strand, and/or rotational to correct for twisting of the strand during casting. The correcting device may be, for example, a mold taper position of the casting mold, roll force or pressure profile of the withdrawal straightener, tilt of the withdrawal straightener, tilt of a set of pinch rolls, cooling sprays onto to the strand adjacent the slab caster, drive speed of a set of pinch rolls, and drive speed of the withdrawal straightener.

These and other advantages and features, as well as details of illustrated embodiments of the disclosure will be more fully understood from the following description and drawings. Further limitations and disadvantages of particular embodiments will also become apparent to one of skill in the art, through comparison of such systems and methods with the embodiments as set forth in the remainder of the present application with reference to the drawings.

DETAILED DESCRIPTION

Figure 1:
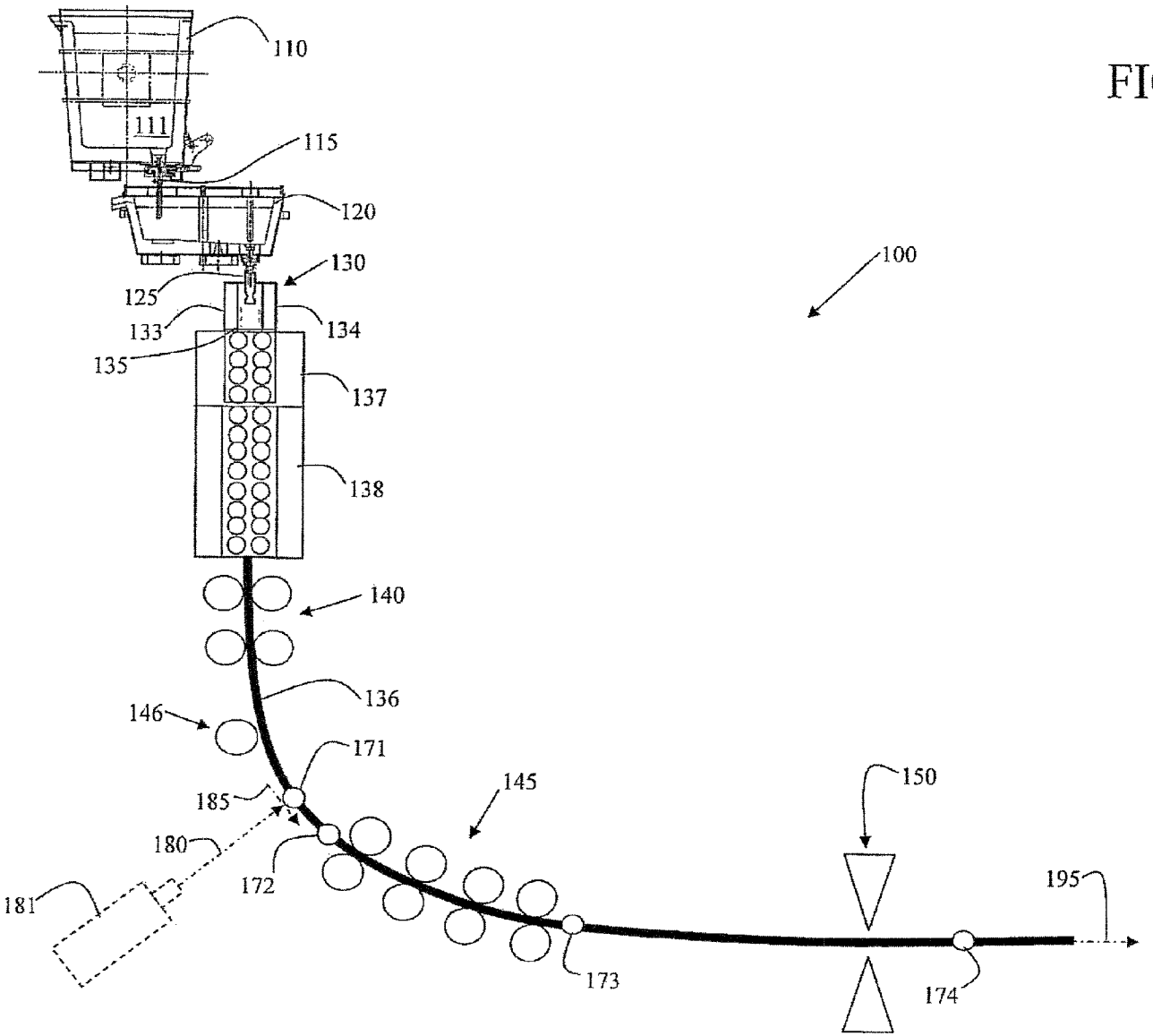
FIG. 1 is a schematic illustration of an embodiment of a continuous slab caster plant.

FIG. 1 is a schematic illustration of an embodiment of a continuous metal slab casting plant 100. The steel slab casting plant 100 includes a ladle 110 to provide molten steel 111 to a tundish 120 through a shroud 115. The tundish 120 directs the molten melt 111 to the casting mold 130 through a submerged entry nozzle (SEN) 125 connected to a bottom of the tundish 120. The casting mold 130 includes at least two opposing mold faces 133 and 134, which may be fixed or moveable. The SEN 125 delivers the molten melt into the casting mold 130 below the surface ("meniscus") of the molten metal in the casting mold 130.

The width of the cast strand 136 leaving the casting mold 130 is substantially determined by the configuration of the caster mold faces at the mold exit at 135. The casting mold 130 has two opposing broad mold faces 133 and 134 and two opposing narrow mold faces (not shown) to form a substantially rectangular configuration, or some other desired configuration for the cast strand 136. At least one pair of the mold faces of the casting mold 130 typically are oscillating to facilitate downward movement of the molten metal through the casting mold 130.

The cast strand 136 leaving the casting mold 130 enters a first containment segment 137 and thereafter a second containment segment 138. The containment segments include containment rolls and may include a spray system to cool the containment rolls and assist in solidifying and orientation of the strand 136 as the strand moves downwardly away from the casting mold 130. In some embodiments, additional containment segments may be provided to increase the throughput of the slab caster 100 by increasing the containment length to produce thicker slabs through the slab caster 100.

The cast strand 136 leaving the containment segment 138 enters two sets of pinch rolls 140 (as shown) below the containment segment 138. The set of pinch rolls 140 serve to feed the cast strand 136 downward from the containment segment 138 and toward a withdrawal straightener 145.

A disconnect roll 146 positioned below the sets of pinch rolls 140 may be provided to initiate downward curving of the cast metal strand 136 toward the withdrawal straightener 145, and to disconnect a starter dummy bar (not shown) from the cast strand 136. The dummy bar allows the start of casting by providing a surface onto which to cast the strand 136 at the start of the casting campaign.

The cast strand 136 enters the withdrawal straightener 145 which serves to transition direction of travel of the strand 136 to a substantially horizontal direction. The withdrawal straightener 145 provides support for the cast strand 136 as the strand cools and progresses at casting speed through the withdrawal straightener 145 toward a cutting tool 150 beyond the withdrawal straightener 145. The withdrawal straightener 145 includes drives for its rolls (not shown) to move the cast strand 136 through the withdrawal straightener 145 as casting proceeds.

By the time the cast metal strand exits the withdrawal straightener 145 and arrives at the cutting tool 150, the cast strand 136 is sufficiently solidified to be cut laterally (i.e., transverse to the direction of travel of the cast strand) to form, for example, slabs, blooms, or billets. The cutting tool 150 may comprise a shear having cutting blades. For thicker strands, a cutting torch, or other cutting mechanism may be more suitable to efficiently cut the cast strand laterally. As the strand 136 is cut into slabs, blooms, or billets, for example, the intermediate product may be transported away on rollers or other supports to be further processed.

During casting, water (or some other coolant) is circulated through the casting mold 130 to cool and solidify the surfaces of the cast strand 136 at the mold faces. The rollers of the withdrawal straightener 145 may also be sprayed with water to further cool the cast strand 136, and if desired provide a correcting device, as the strand 136 travels through the withdrawal straightener 145. Each time the strand 136 is cut by the cutting tool 150, an intermediate product is formed having a predetermined length.

In an embodiment of the slab caster, the position of the cast metal strand 136 is monitored at three or four separate locations 171-174 along the direction of travel of the strand along the casting path using position sensors (e.g., sensor 181). Sensors 210-210' at first monitored location 172 detects a lateral position of the cast strand 136 adjacent entry to the withdrawal straightener 145. Sensor 220-220' at second monitored location 173 detects a lateral position of the cast strand 136 adjacent exit of the strand 136 from the withdrawal straightener 145. Sensors 230-230' at third monitored location 174 detects a lateral position of the cast metal strand 136 adjacent exit of the strand 136 from the cutting tool 150 or further downstream from the cutting tool 150. When a strand is cut to form an intermediate product, tension is released in the strand and may cause the slab to shift in position. The sensors after the cutting tool serve to give an indication if there is a problem with the cutting tool (e.g., dull blades) or if the slab is off the direction of travel. As used herein, the term "downstream" means further along the direction of travel of the cast strand through and out of the slab caster during the casting campaign.

Sensor 181 at fourth monitored location 171 adjacent the withdrawal straightener 145 and adjacent the set of pinch rolls 140 detects an elevation position of a curved section of the cast strand 136. Monitoring at location 171 is optional.

As used herein, the term "elevation position" refers to a position of the cast strand 136, along the direction of sensing (e.g., 180), that is substantially orthogonal to a direction of travel (e.g., 185) of the cast strand through the continuous slab caster plant 100, and which is also substantially orthogonal to a lateral direction of detection.

Figure 2:
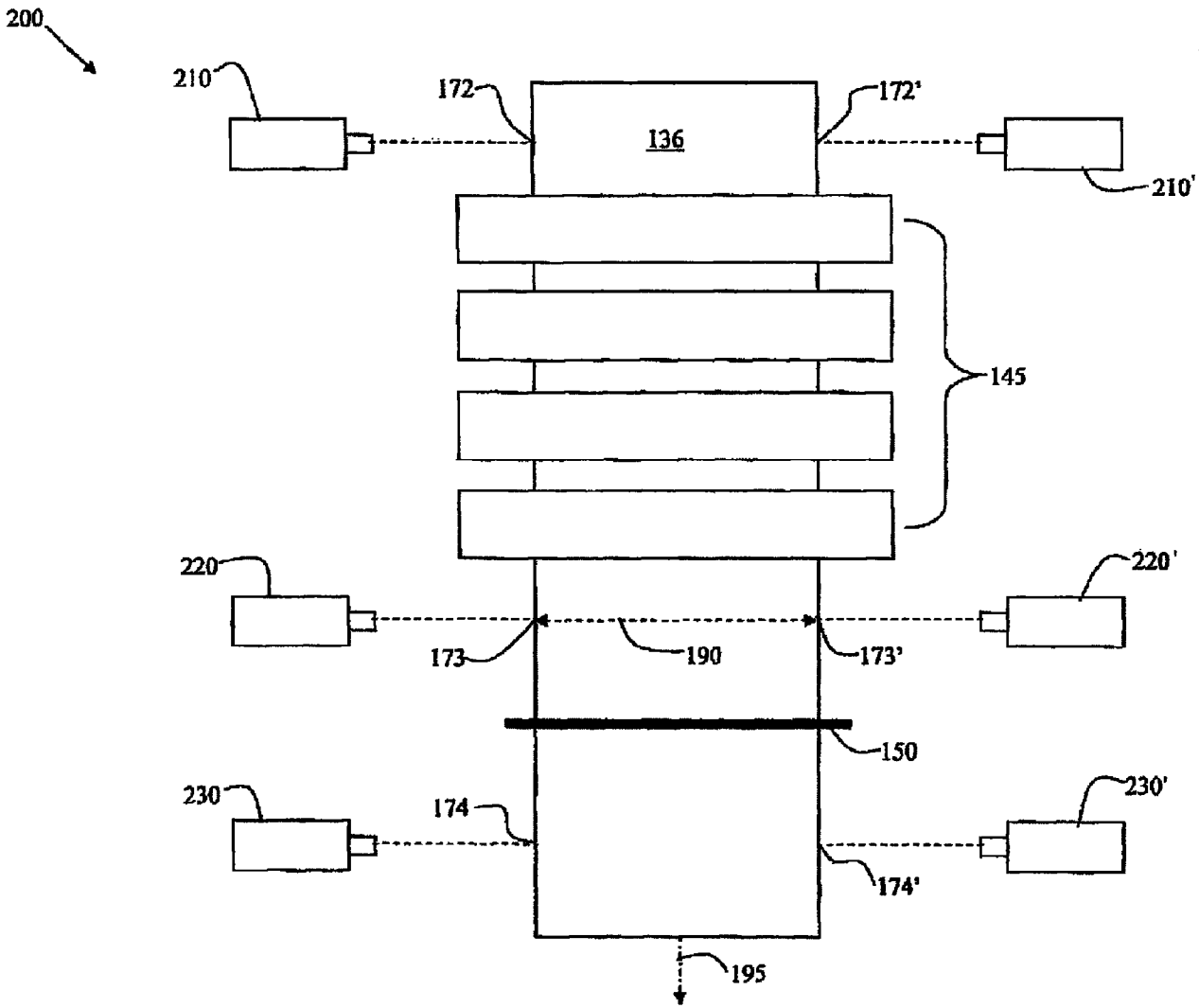
FIG. 2 is a schematic illustration of a top view of a portion of the continuous slab caster plant of FIG. 1.

FIG. 2 is a schematic illustration of a plan view of a portion 200 of the continuous metal slab casting plant 100 of FIG. 1, in accordance with an embodiment. As used herein, the term. "lateral position" refers to a position of the cast strand, along a direction of sensing (e.g., 190, see FIG. 2), that is substantially orthogonal to the direction of travel of the cast strand (e.g., 195) and to the elevation direction of detection (sensing).

In an embodiment shown in FIG. 2, a first pair of sensors 210 and 210' are shown which are used to monitor a first pair of lateral locations 172 and 172', respectively, on opposite narrow sides of the cast strand 136 at an entry to the withdrawal straightener 145. A second pair of sensors 220 and 220' are shown which are used to monitor a second pair of lateral locations 173 and 173', respectively, on opposite narrow sides of the cast strand 136 adjacent exit from the withdrawal straightener 145. A third pair of sensors 230 and 230' are shown which are used to monitor a third pair of lateral locations 174 and 174', respectively, on opposite sides of the cast strand 136 adjacent exit of the cutting tool 150.

The sensors at the first, second and third lateral positions are used to detect if the cast strand 136 is deviating laterally from the desired positions through the slab caster. Information collected by the sensors is used to generate control signals which may be used to steer the cast strand into the desired positions as the casting campaign proceeds. Optionally, instead of using pairs of opposing sensors to monitor lateral position, a single sensor may be used at each lateral location on one narrow side of the cast strand. However, the opposing pairs of sensors provide an indication of the thickness of the strand and, if properly positioned at the edges of the strand, twisting of the cast strand relative to the desired orientation along direction of travel.

The sensors 181, 210 and 210', 220 and 220', and 230 and 230' sense the respective elevational or lateral positions of the cast strand 136, and generate position data that may be transmitted to one or more computer units as the cast strand moves through the casting plant 100. Elevation or lateral movements, or drifting, of the strand may be detected by the sensors 181, 210 and 210', 220 and 220', and 230 and 230' at their respective monitored locations along the cast strand 136 as shown in FIG. 1 and FIG. 2. As noted, monitoring of the elevation location 171 is optional.

In an embodiment, the sensors 181, 210 and 210', 220 and 220', and 230 and 230' are laser-based position sensors where each illuminate the strand 136 with a laser beam and detect reflected laser energy from the strand to detect the position of the strand by determined time of flight of the laser beam and reflected laser energy. Alternatively, other sensor types that are capable of detecting position or proximity may be used as desired in the particular embodiment including, among others, eddy current sensors, inductive sensors, Hall effect sensors, variable reluctance sensors, fiber optic sensors.

Figure 3:
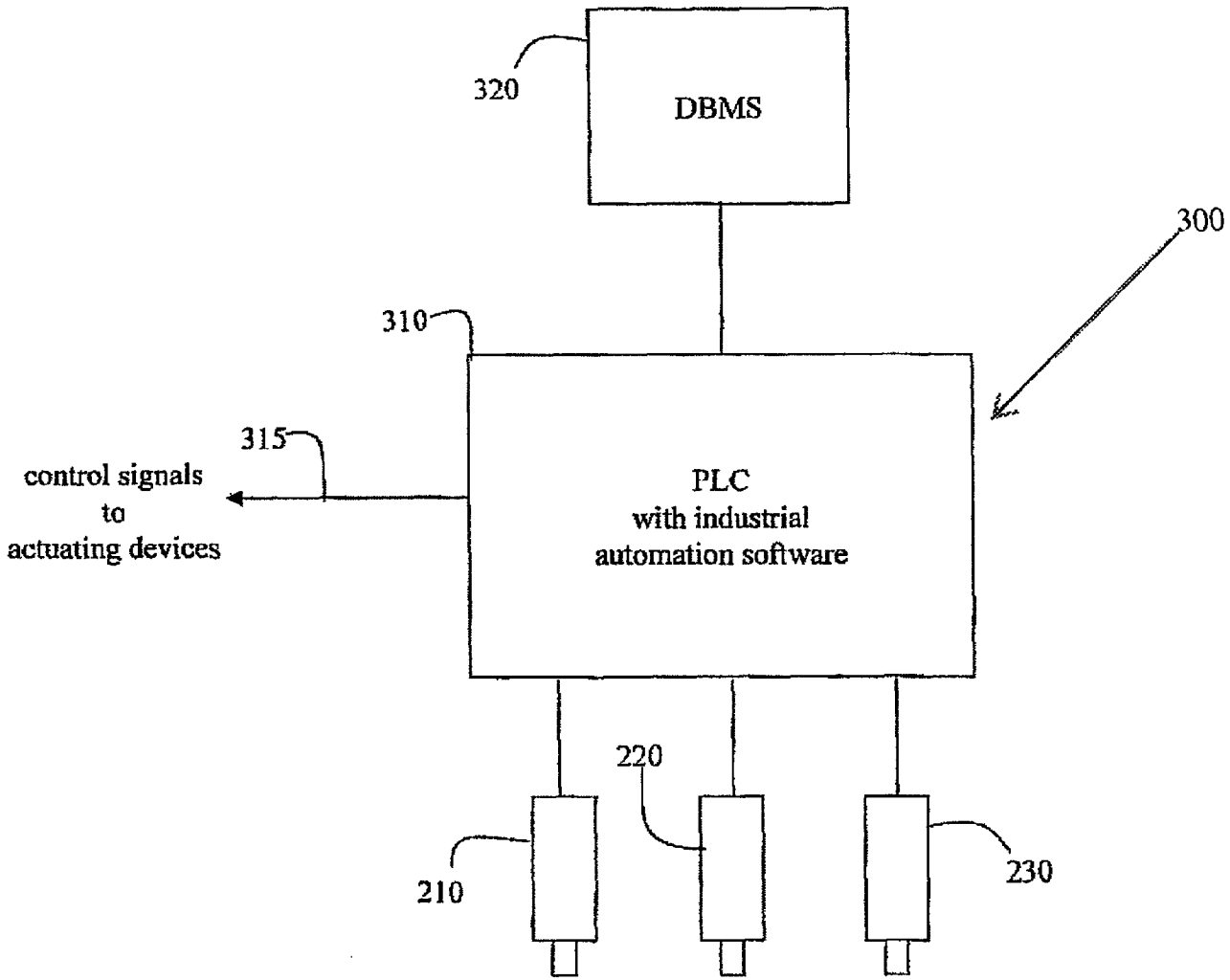
FIG. 3 is a schematic illustration of an embodiment of a computer-based apparatus portion of a system for monitoring and controlling a cast strand through the slab caster plant of FIG. 1.

FIG. 3 is a schematic illustration of an embodiment of a computer-based apparatus portion 300 of a system for monitoring and controlling a cast metal strand 136 through the slab casting plant 100 of FIG. 1. The computer-based apparatus portion 300 includes a programmable logic controller (PLC) 310 and a database management system (DBMS) 320 electrically connected to the PLC 310. The sensors 181, 210 and 210', 220 and 220', and 230 and 230' are electrically connected to the computer-based apparatus portion 300 via the PLC 310. FIG. 3 shows three sensors (e.g., 210, 220, and 230) electrically interfacing to the PLC 310.

The PLC 310 has an electrical connection to the sensors to transmit command and/or sensor control signals to the sensor and to receive position signals/data from the sensors. If the signal from the sensor is an analog electrical signal, the PLC 310 converts the analog electrical signal into a digital electrical signal/digital data. For example, in an embodiment, the electrical signal from the sensor is a 4 to 20 mA signal that is processed by the PLC 310 and converted to a distance/location value. If the electrical signal from the sensor is already in digital form, the PLC 310 may pre-process the digital data or simply re-package the digital data, and forward the re-packaged digital data to the DBMS 320.

In an embodiment, the PLC forwards the digital position data to the DBMS 320 to be stored. The digital position data forwarded is tagged with other information including an identifier corresponding to the sensor that acquired the position data, and a time at which the position data was acquired. The sensor identifier is associated with the location of the sensor and the monitored positions of the cast strand 136 (e.g., the elevation position at location 171 or one of the lateral positions at locations 172-174).

Each sensor is identified using a standard database access method (e.g., Open Database Connectivity (ODBC)). ODBC is a standard database access method which makes it possible to access any data from any application, independent of which DBMS is handling the data. ODBC is a common framework for accessing and changing the contents of a database.

Position data is collected and stored by the DBMS 320 from the sensors in a similar manner. The DMBS 320 then associates the various position data from the various sensors such that the monitored positions of the cast strand 136 are known from the sensors for a particular acquisition time. The process is repeated, collecting and associating position data from the various sensors at various intervals of time (e.g., at a sample rate of 5 Hz). As a result, the characteristic positions of the cast strand 136 are constantly known and updated as casting proceeds.

Before data acquisition begins, each sensor registers a known and accepted position value through calibration or zeroing, establishing the standard for the desired direction of travel of the cast strand through the slab caster. Deviations from the standard may be detected and corrected as described herein.

The DBMS 320 sends the associated position data (e.g., from the sensors) back to the PLC 310. The PLC 310 operates on the associated position data using automation software to generate at least one control signal 315 which is used to control an actuating device of the slab caster plant 100. As a result, feedback and/or feed-forward control may be established between the sensors and the correcting devices.

In an embodiment, the control signals 315 may be used to control multiple correcting devices to adjust or modify the direction of travel of the cast strand to the desired positions (e.g., elevational and lateral) of the cast strand 136 as casting proceeds. The correcting devices may include any of various types of mechanical, electrical, electro-mechanical, hydraulic, or pneumatic actuating devices. The correcting devices may control/adjust one or more of, for example, mold taper of the casting mold 130, roll force or pressure profile of the withdrawal straightener 145, tilt of the withdrawal straightener 145, tilt of the set of pinch rolls 140, cooling spray onto rolls of the withdrawal straightener and/or containment sections 137 and/or 138, drive speed of the set of pinch rolls 140, and drive speed of the withdrawal straightener 145 in order to maintain the desired positions (i.e., the standard) of the cast strand 136 along the direction of travel of the strand through the slab caster plant.

Figure 4:
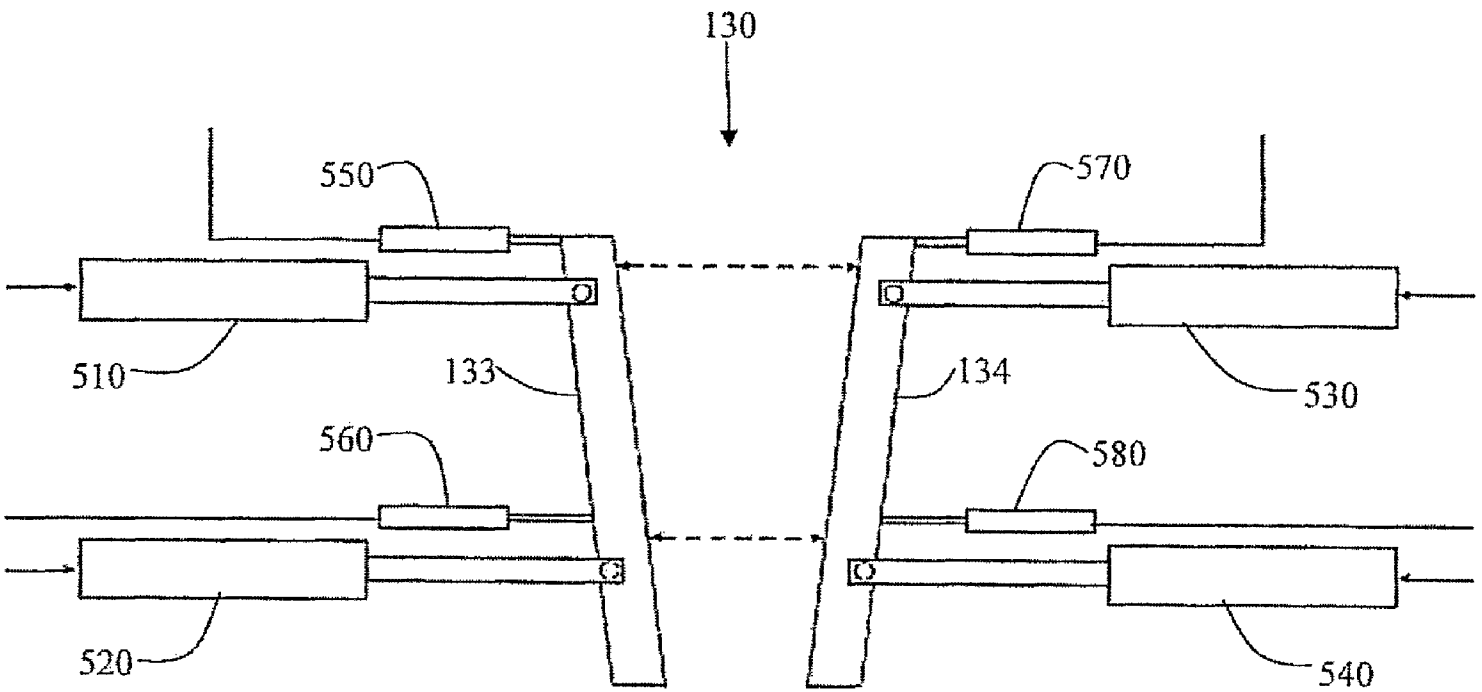
FIG. 4 is a schematic illustration of an embodiment of correcting devices electrically connected to a casting mold of the slab caster plant of FIG. 1 to control or adjust the taper of the mold, and which are electrically controlled by the computer-based apparatus portion of the system for monitoring and controlling a cast strand of FIG. 3.

For example, FIG. 4 is a schematic illustration of an embodiment of correcting devices 510-540 electrically connected to a casting mold 130 of the slab caster plant 100 of FIG. 1 to control the taper of the mold 130. Correcting devices 510-540 are electrically controlled by the computer-based apparatus portion 300 of the system for monitoring and controlling a cast strand of FIG. 3. The actuating devices 510-540 may comprise hydraulic cylinders, for example, electrically connected to the faces 133 and 134 of the mold 130 and controlled by certain control signals 315. Linear position sensors 550-580 may be used to sense the positions of the mold faces 133 and 134 and provide feedback information to, for example, the computer-based apparatus portion 300 for verification of mold taper. Such sensors 550-580 may use the same or similar technology as the sensors 181 and 210 to 230. Details of controlling mold face position and taper may be found in U.S. patent application Ser. No. 11/627,511 filed on Jan. 26, 2007 which is incorporated herein by reference.

Figure 5:
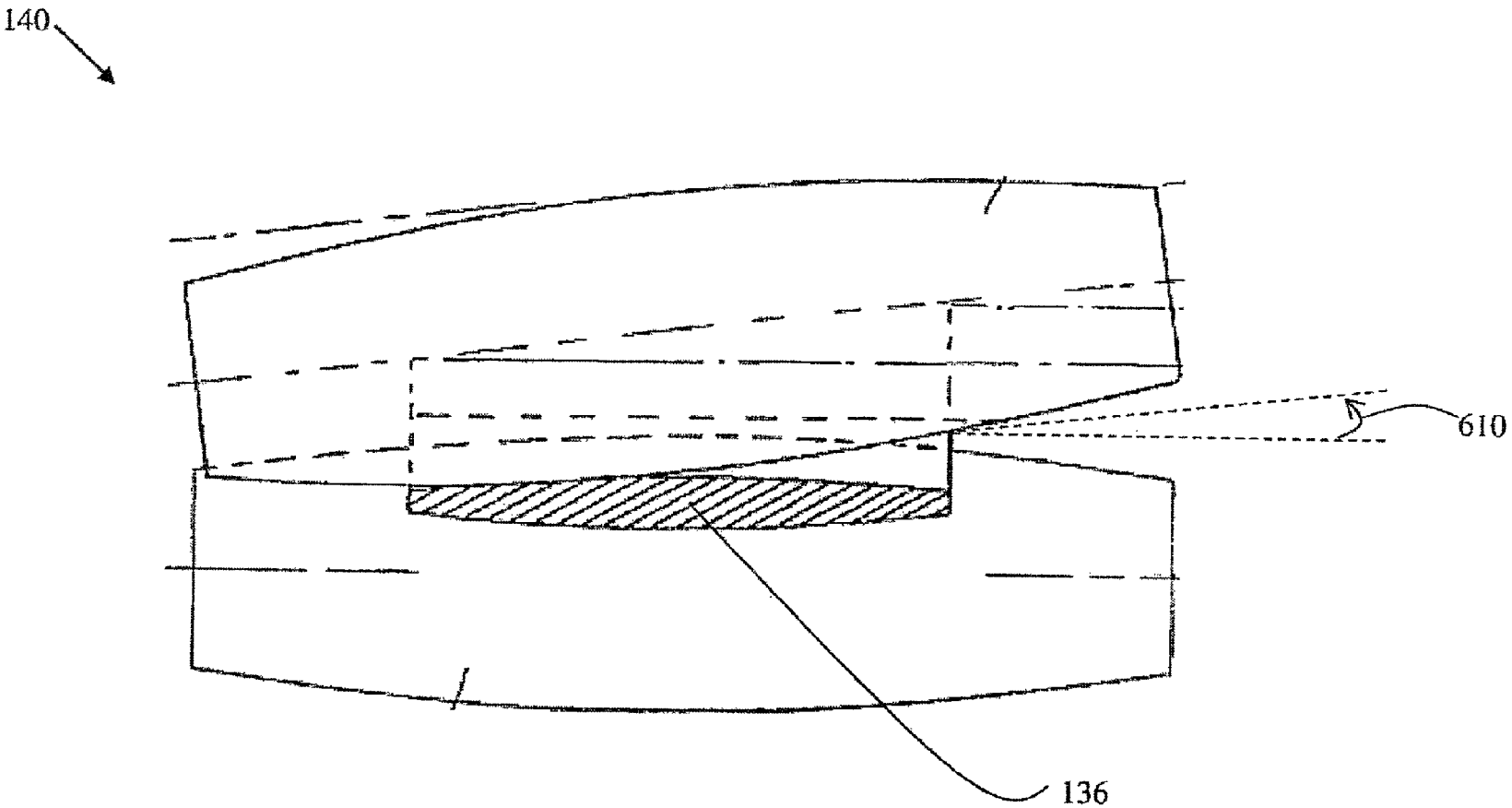
FIG. 5 is a schematic illustration of an embodiment of a set of pinch rolls used in the slab caster plant of FIG. 1 showing how the pinch rolls may be electrically controlled or adjusted (e.g., tilted) by the computer-based apparatus portion of the system for monitoring and controlling a cast strand of FIG. 3.

FIG. 5 is a schematic illustration of an embodiment of a set of pinch rolls 140 used in the slab caster plant 100 of FIG. 1 showing how the pinch rolls 140 may be electrically controlled (e.g., tilted with respect to each other) by the computer-based apparatus portion 300 of the system for monitoring and controlling a cast strand of FIG. 3. Again, correcting devices (not shown) of one of the types described above may be used to control and adjust the tilt 610 of the pinch rolls 140 in response to certain control signals 315. Other correcting devices (e.g., drive motors) may be used to control and adjust a drive speed of the pinch rolls 140 in response to other certain control signals 315.

Figure 6:
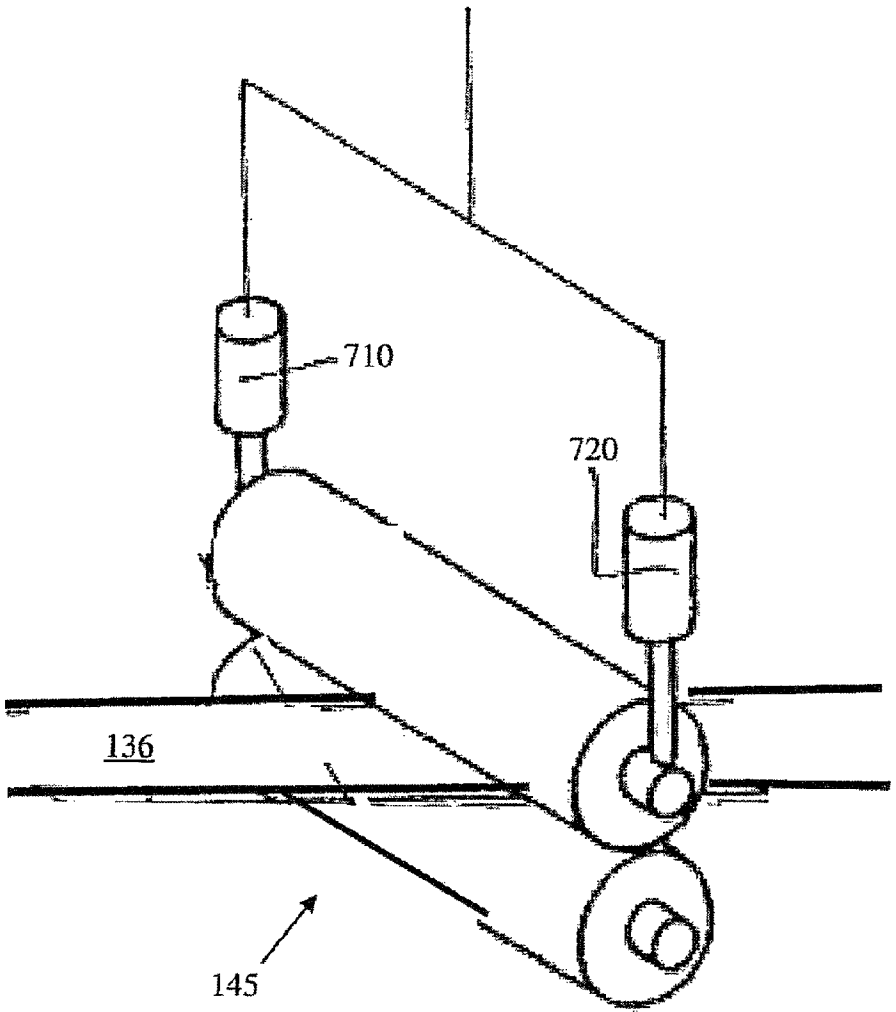
FIG. 6 is a schematic illustration of an embodiment of correcting devices electrically connected to a portion of a withdrawal straightener used in the slab caster plant of FIG. 1 which are electrically controlled by the computer-based apparatus portion of the system for monitoring and controlling a cast strand of FIG. 3.

FIG. 6 is a schematic illustration of an embodiment of correcting devices 710 and 720 electrically connected to a portion of a withdrawal straightener 145 used in the slab caster plant 100 of FIG. 1 which are electrically controlled by the computer-based apparatus portion 300 of the system for monitoring and controlling a cast strand of FIG. 3. Again, correcting devices of one of the types described above may be used to control/adjust the tilt and/or roll force or pressure profile of the withdrawal straightener 145 in response to certain control signals 315. Other correcting devices (e.g., drive motors) may be used to control a drive speed of the withdrawal straightener 145 in response to other certain control signals 315.

Figure 7:
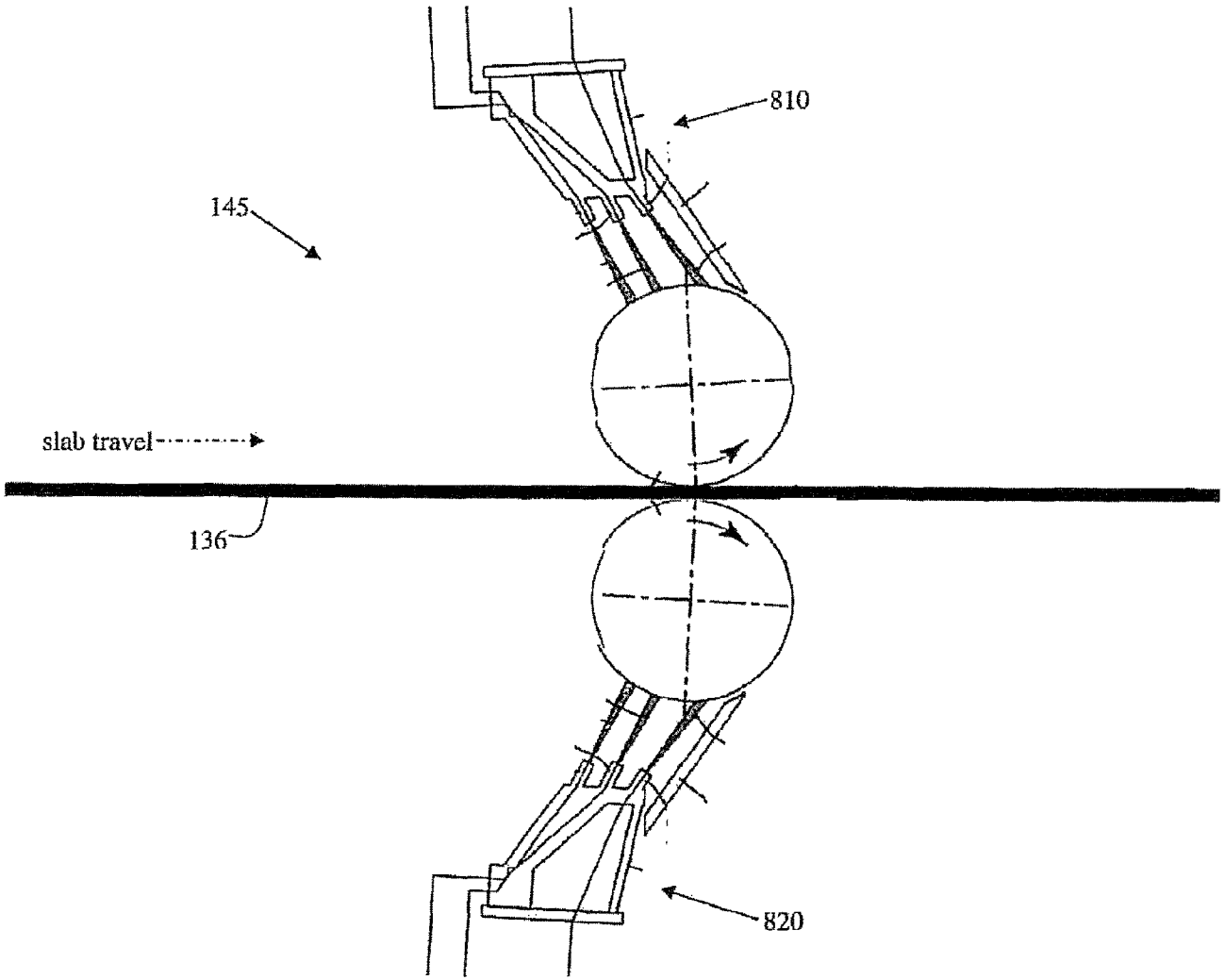
FIG. 7 is a schematic illustration of an embodiment of cooling spray devices used to cool a portion of a withdrawal straightener used in the slab caster plant of FIG. 1 which are electrically controlled by the computer-based apparatus portion of the system for monitoring and controlling a cast strand of FIG. 3.

FIG. 7 is a schematic illustration of an embodiment of cooling sprayers 810 and 820 used to cool rolls, for example, of a withdrawal straightener 145 and/or containment segments 137 and 138 used in the slab caster plant 100 of FIG. 1 which are electrically controlled by the computer-based apparatus portion 300 of the system for monitoring and controlling a cast strand 136 of FIG. 3. Spraying the rolls of the withdrawal straightener 145 prevent build up of scales on the rolls which may cause defects and affect the position of the cast strand 136 through the withdrawal straightener 145.

A method of monitoring and controlling a cast strand 136 as casting proceeds in the continuous slab caster 100 of FIG. 1 is disclosed. As an optional part of the method, an elevation position of a curved section of a cast strand 136 is monitored adjacent a withdrawal straightener 145 and adjacent a set of pinch rolls 140 (if the pinch rolls are present). A broad side of the curved section of the cast strand is monitored as casting proceeds. A first lateral position of the cast strand is monitored at entry of the strand to the withdrawal straightener. A second lateral position of the cast strand is monitored adjacent exit of the withdrawal straightener. A third lateral position of the cast strand is monitored adjacent exit of the strand from a cutting tool 150. As described previously herein, for the lateral monitoring, pairs of sensors may be used to measure the positions of the opposing edges of the narrow sides of the cast strand. In this way, the width, lateral position and twist of the strand 136 may be monitored. Therefore, when controlling the position of the strand 136 during casting, position may be controlled such that pressures do not distort the cast strand from a standard, and change the width and wandering of the cast strand from the desired direction of travel. The monitored positions are electronically stored as associated data in a computer-based system 300 as described previously herein.

A method of continuously casting steel slabs using the slab caster plant 100 of FIG. 1 is disclosed. A continuous slab caster 100 is assembled having a vertically-oriented casting mold 130, optionally a set of pinch rolls 140 positioned downstream of the casting mold, a withdrawal straightener 145 positioned downstream of the mold and/or set of pinch rolls, and a cutting tool 150 positioned downstream of the withdrawal straightener. Again, as described above, the term "downstream" means further along the direction of casting. A first pair of position-detecting sensors 230/230' are mounted adjacent exit of the cutting tool and positioned to detect laterally with respect to a direction of casting through the continuous metal slab caster. A second pair of position-detecting sensors 220/220' are mounted adjacent exit of the withdrawal straightener and positioned to detect laterally with respect to the direction of casting. A third pair of position-detecting sensors 210/210' are mounted adjacent entry to the withdrawal straightener and positioned to detect laterally with respect to the direction of travel of the strand during casting. As an option, a fourth position-detecting sensor 181 is mounted adjacent the withdrawal straightener and/or adjacent the set of pinch rolls and positioned to substantially detect orthogonally to the direction of travel of the strand during casting.

A computer-based system 300 is assembled and electrically connected to the sensors. Molten metal is introduced into the casting mold and a cast strand 136 exits downward out of the casting mold, optionally through the pinch rolls, through the withdrawal straightener, and through the cutting tool in the direction of travel during casting. As an option, an elevational position of the cast strand is monitored using the fourth sensor as casting proceeds. Lateral positions of the cast strand are monitored using the first, second, and third pairs of sensors as casting proceeds. The monitored positions are electronically stored as associated data in the computer-based system.

As described previously herein, the associated data is used (e.g., analyzed) to generate control signals to control correcting devices associated with control of the casting mold, the pinch rolls, and/or the withdrawal straightener, in order to control the positioning of the cast metal strand 136 through the casting plant 100 as casting proceeds.

As an example, referring to FIG. 2, if the strand 136 begins to drift laterally in position at locations 173 and 173', the sensors 220/220' detect the drift and the computer-based system 300 generates control signals 315 in response to the detected drift which causes a correcting device, such as, the withdrawal straightener 145 to apply different pressures to different sides of the cast strand and steer the strand 136 back into the desired direction of travel. The sensors 220/220' continue to monitor the lateral positions of the strand 136 at the locations 173 and 173' such that the computer-based system 300 may verify that the drift has been corrected.

Figure 8:
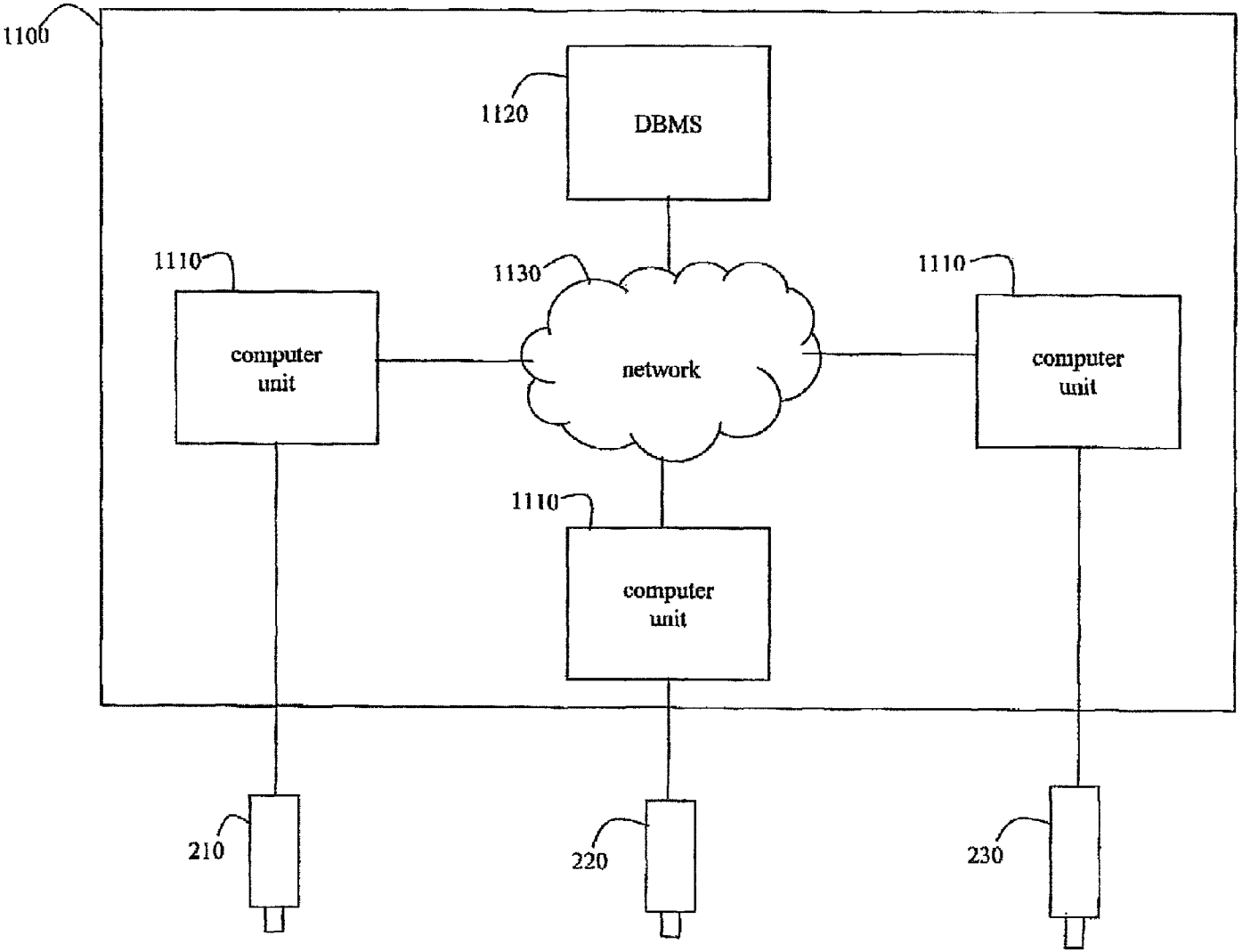
FIG. 8 is a schematic illustration of an alternative embodiment of a computer-based architecture portion of a system for monitoring and controlling a cast strand through the casting plant of FIG. 1.

FIG. 8 is a schematic illustration of an alternative embodiment of a computer-based architecture portion 1100 of a system for monitoring and controlling a cast strand 136 through the slab caster plant 100 of FIG. 1. The computer-based architecture portion 1100 includes at least one computer unit 1110, a database management system (DBMS) 1120, and a network 1130 connecting at least one computer unit 1110 to the DBMS 1120. The sensors 181, 210 and 210', 220 and 220', and 230 and 230' electrically interface to the computer-based architecture portion 1100 via the computer units 1110. FIG. 10 shows three sensors (e.g., 210, 220, and 230) electrically interfacing to three computer units 1110. The computer-based architecture may include as many computer units 1110 as deemed necessary to interface to a number of sensors being used.

In an embodiment, there is a one-to-one correspondence between each computer unit 1110 and each sensor. Alternatively, an embodiment is shown in FIG. 3 where multiple sensors interface to a single computer unit (i.e., the PLC 310). The network 1130 may be a local area network (LAN) which allows communication between the various computer units 1110, and between the DBMS 1120 and the various computer units 1110.

Figure 9:
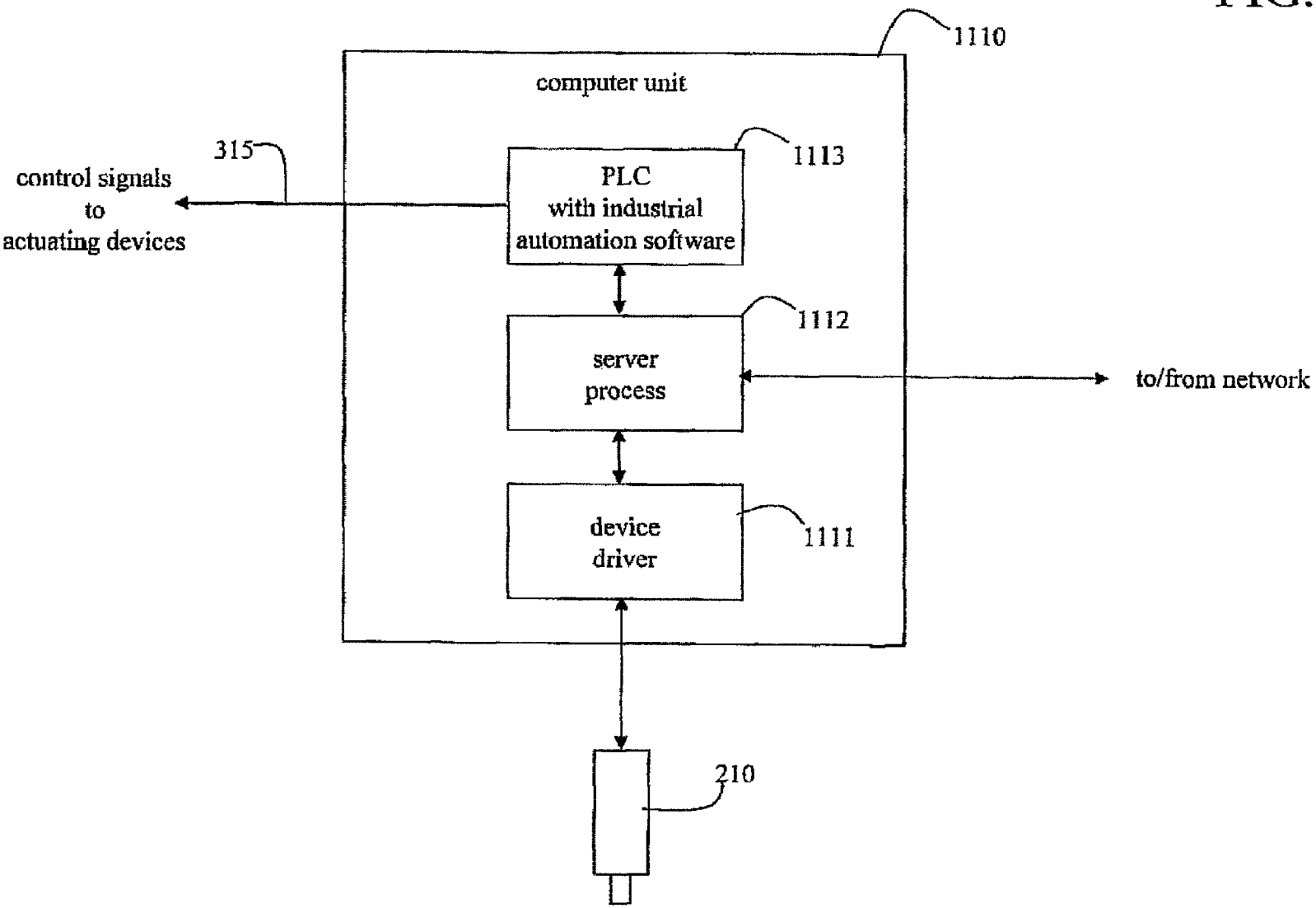
FIG. 9 is a schematic illustration of an embodiment of a computer unit used in the computer-based architecture portion of FIG. 8.

FIG. 9 is a schematic illustration of an embodiment of a computer unit 1110 used in the computer-based architecture portion 1100 of FIG. 8. The computer unit 1110 includes a device driver 1111, a server process 1112, and a programmable logic controller (PLC) 1113 programmed with automation software. The device driver 1111 is the part of the computer unit 1110 that establishes an operational interface with a sensor (e.g., 210) to receive position signals or data from the sensor and to transmit command and/or sensor control signals to the sensor. If the signal from the sensor is an analog electrical signal, the device driver 1111 converts the analog electrical signal into a digital electrical signal or digital data. If the signal from the sensor is already in digital form, the device driver 1111 may pre-process the digital data or simply re-package the digital data and forward the re-packaged digital data to the server process 1112.

The computer unit 1110 electrically interfaces to the network 1130 via the server process 1112. In general a server process is a program that fulfills a request by a customer by performing the requested task (e.g., tagging and forwarding digital position data to the DBMS). Server programs generally receive requests from client programs, execute database updates and retrievals, manage data integrity, and dispatch responses to client requests. The server process acts as a software engine to manage shared resources such as databases, communication links, and processors (e.g., a PLC).

In an embodiment, the server process 1112 receives the digital position data from the device driver 1111 and forwards the digital position data to the DBMS 1120 via the network 1130 to be stored. In an embodiment the digital position data forwarded by the server process 1112 is tagged with other information including an identifier corresponding to the sensor which acquired the position data and a time at which the position data was acquired. The sensor identifier is associated with the location of the sensor with respect to the monitored positions of the cast strand 136 (e.g., at the elevation location 171 or at one of the lateral locations 172-174).

Each sensor is identified using a standard database access method (e.g., Open Database Connectivity (ODBC)). ODBC is a standard database access method which makes it possible to access any data from any application, independent of which DBMS is handling the data. ODBC is a common framework for accessing and changing the contents of a database.

Position data is collected and stored by the DBMS 1120 from the sensors in a similar manner as described above. The DMBS 1120 then associates the various position data from the various sensors such that the desired positions of the cast strand 136 are known from the sensors for a particular acquisition time. The process is repeated, collecting and associating position data from the various sensors at various intervals of time (e.g., at a sample rate of 5 Hz). As a result, the characteristic positions of the cast strand 136 are continually known and updated as casting proceeds.

Before data acquisition begins, each sensor registers a known and accepted position value through calibration to a known or desired standard. Deviations from the standard may be detected and corrected as described herein.

The DBMS 1120 sends the associated position data (e.g., from the sensors) back to the server process 1112 via the network 1130. The server process 1112 then forwards the associated position data to the PLC 1113. The PLC 1113 operates on the associated position data using industrial automation software to generate at least one control signal 315 which is used to control an actuating device (i.e., a correcting device) of the casting plant 100. As a result, feedback and/or feed-forward control may be established between the sensors and the correcting devices.

When there is more than one computer unit 1110, the DBMS 1120 may send the associated position data to any or all of the server processes 1112 of the computer units 1110 via the network 1130, such that the PLCs 1113 of the various computer units 1110 generate multiple control signals 315 for correcting device control.

In summary, a system and method for tracking and positioning a continuous cast strand in a slab caster plant are disclosed. Various lateral positions and, optionally, elevational positions of a cast strand are monitored by sensors as casting proceeds, and are fed back to a computer-based system as corresponding position information where the information is stored as associated data. The computer-based system processes the associated data and generates corresponding control signals which are used to control various actuators of the correcting devices of the casting plant to maintain desired positions of the cast strand as casting proceeds.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the following claims.

What is claimed is:

1. A method of monitoring and controlling a cast strand as casting proceeds in a continuous slab caster, said method comprising the steps of:

monitoring a first lateral position of a cast strand adjacent entry to a withdrawal straightener;

monitoring a second lateral position of said cast strand adjacent exit from said withdrawal straightener;

monitoring a third lateral position of said cast strand downstream of a cutting tool; and electronically storing said monitored lateral positions as associated data in a computer-based system and using the associated data to actuate at least one correcting device capable of adjusting the orientation of the strand during casting to correct for twisting of the strand.

2. The method of monitoring and controlling said cast strand as casting proceeds in said continuous slab caster of claim 1 further comprising:

monitoring an elevation position of a curved section of said cast strand adjacent said withdrawal straightener and optionally adjacent a set of pinch rolls; and electronically storing said monitored elevation position in said computer-based system as a portion of said associated data and using said associated data to actuate at least one correcting device capable of adjusting the orientation of the strand during casting.

3. The method of monitoring and controlling said cast strand as casting proceeds in said continuous slab caster of claim 2 where monitoring of said elevation position is accomplished by detecting an elevation location of a first broad side of said cast strand.

4. The method of monitoring and controlling said cast metal strand as casting proceeds in said continuous metal slab caster of claim 1 where monitoring of each of said lateral positions is accomplished by detecting a first lateral location of a first narrow side of said cast strand and a second lateral location of a second opposite narrow side of said cast strand.

5. The method of monitoring and controlling said cast strand as casting proceeds in said continuous slab caster of claim 3 where said detecting is accomplished by using a single laser sensor capable of monitoring elevation position.

6. The method of monitoring and controlling said cast strand as casting proceeds in said continuous slab caster of claim 4 where said detecting is accomplished by using a pair of laser sensors capable of monitoring lateral position.

7. The method of monitoring and controlling said cast strand as casting proceeds in said continuous slab caster of claim 1 further comprising processing said stored associated data within said computer-based system to generate at least one control signal.

8. The method of monitoring and controlling said cast strand as casting proceeds in said continuous slab caster of claim 1 further comprising processing said stored associated data within said computer-based system to generate at least one feed-forward control signal and at least one feedback control signal.

9. The method of monitoring and controlling said cast strand as casting proceeds in said continuous slab caster of claim 7 where the correcting device controls one or more of mold taper of a casting mold, roll force or pressure profile of said withdrawal straightener, tilt of said withdrawal straightener, tilt of said set of pinch rolls, cooling spray on said withdrawal straightener, drive speed of said set of pinch rolls, and drive speed of said withdrawal straightener in response to said at least one control signal.

10. The method of monitoring and controlling said cast strand as casting proceeds in said continuous slab caster of claim 8 where the correcting device controls one or more of mold taper of a casting mold, roll force or pressure profile of said withdrawal straightener, tilt of said withdrawal straightener, tilt of a set of pinch rolls, cooling spray of said withdrawal straightener, drive speed of a set of pinch rolls, and drive speed of said withdrawal straightener and is controlled in response to said at least one feed-forward control signal and said at least one feedback control signal.

11. A system for monitoring and controlling a cast strand as casting proceeds in a continuous slab caster, said system comprising:

a first pair of position-detecting sensors positioned laterally along direction of travel of said cast strand adjacent entry to said withdrawal straightener;

a second pair of position-detecting sensors positioned laterally along direction of travel of said cast strand adjacent exit of said withdrawal straightener;

a third pair of position-detecting sensors positioned laterally along direction of travel of said cast strand downstream of a cutting tool; and a computer-based apparatus electrically connected to said sensors and using associated data to actuate at least one correcting device capable of adjusting the orientation of the strand during casting to correct for twisting of the strand.

12. The system for monitoring and controlling a cast strand as casting proceeds in a continuous slab caster of claim 11 further comprising a fourth position-detecting sensor positioned along direction of travel of said cast strand adjacent said withdrawal straightener and optionally adjacent a set of pinch rolls and being electrically connected to said computer-based apparatus generating associated data to actuate at least one correcting device.

13. The system for monitoring and controlling a cast strand as casting proceeds in a continuous slab caster of claim 11 where said sensors include laser devices.

14. The system for monitoring and controlling a cast strand as casting proceeds in a continuous slab caster of claim 11 where said computer-based apparatus includes a programmable logic controller (PLC).

15. The system for monitoring and controlling a cast strand as casting proceeds in a continuous slab caster of claim 11 where said computer-based apparatus is capable of being programmed with automation software.

16. The system for monitoring and controlling a cast strand as casting proceeds in a continuous slab caster of claim 11 where said computer-based apparatus is capable of receiving a position signal, corresponding to a detected position of said cast strand, from at least one of said sensors and generating at least one control signal in response to said position signal to actuate at least one correcting device.

17. The system for monitoring and controlling a cast strand as casting proceeds in a continuous slab caster of claim 11 where said computer-based apparatus is capable of receiving a position signal, corresponding to a detected position of said cast strand, from at least one of said sensors and generating at least one feed-forward control signal and at least one feedback control signal in response to said position signal.

18. The system for monitoring and controlling a cast strand as casting proceeds in a continuous slab caster of claim 16 where the correcting device controls one or more of mold taper of a casting mold, roll force or pressure profile of said withdrawal straightener, tilt of said withdrawal straightener, tilt of a set of pinch rolls, cooling spray of said withdrawal straightener, drive speed of a set of pinch rolls, and drive speed of said withdrawal straightener and capable of being controlled in response to said at least one control signal.

19. The system for monitoring and controlling a cast strand as casting proceeds in a continuous slab caster of claim 17 where the correcting device controls one or more of mold taper of a casting mold, roll force or pressure profile of said withdrawal straightener, tilt of said withdrawal straightener, tilt of a set of pinch rolls, cooling spray of said withdrawal straightener, drive speed of a set of pinch rolls, and drive speed of said withdrawal straightener and is capable of being controlled in response to said at least one feed-forward control signal and said at least one feedback control signal.

20. The system for monitoring and controlling a cast strand as casting proceeds in a continuous slab caster of claim 14 where said computer-based apparatus further includes a database management system (DBMS) electrically interfacing to said programmable logic controller (PLC) and being capable of storing position data received from said programmable logic controller (PLC), where said position data is generated by said programmable logic controller (PLC) from position signals received from said sensors.

21. A method of continuously casting steel slabs comprising the steps of:

assembling a continuous metal slab caster having a vertically-oriented casting mold, optionally a set of pinch rolls positioned downstream of said mold, a withdrawal straightener positioned downstream of said mold and/or said set of pinch rolls, and a cutting tool positioned downstream of said withdrawal straightener;

assembling a first pair of position-detecting sensors adjacent entry to said withdrawal straightener and positioned to laterally detect with respect to a direction of casting;

assembling a second pair of position-detecting sensors adjacent exit of said withdrawal straightener and positioned to laterally detect with respect to said direction of casting;

assembling a third pair of position-detecting sensors adjacent exit of said cutting tool and positioned to laterally detect with respect to said direction of casting;

assembling a computer-based system electrically connected to said sensors;

introducing molten metal into said casting mold and casting a strand downward out of said mold, optionally through said pinch rolls, through said withdrawal straightener, and through said cutting tool;

monitoring lateral positions of said cast strand using said first, second, and third pairs of sensors as casting proceeds; and electronically storing said monitored positions as associated data in said computer-based system and using the associated data to actuate at least one correcting device capable of adjusting the orientation of the strand during casting to correct for twisting of the strand.

22. The method of continuously casting steel slabs of claim 21 further comprising:

processing said associated data using said computer-based system; and generating at least one control signal in response to said processing to actuate at least one correcting device capable of adjusting the orientation of the strand during casting.

23. The method of continuously casting steel slabs of claim 21 further comprising:

processing said associated data using said computer-based system; and generating at least one feed-forward control signal and at least one feedback control signal in response to said processing to actuate at least one correcting device capable of adjusting the orientation of the strand during casting.

24. The method of continuously casting steel slabs of claim 22 where the correcting device adjusts one or more of mold taper of said casting mold, roll force or pressure profile of said withdrawal straightener, tilt of said withdrawal straightener, tilt of said set of pinch rolls, cooling spray of said slab caster, drive speed of said set of pinch rolls, and drive speed of said withdrawal straightener and being capable of being controlled in response to said at least one control signal.

25. The method of continuously casting steel slabs of claim 23 where the controlling device adjusts one or more of mold taper of said casting mold, roll force or pressure profile of said withdrawal straightener, tilt of said withdrawal straightener, tilt of said set of pinch rolls, cooling spray of said slab caster, drive speed of said set of pinch rolls, and drive speed of said withdrawal straightener and capable of being controlled in response to said at least one feed-forward control signal and said at least one feedback control signal.

26. The method of continuously casting steel slabs of claim 21 further comprising:

assembling a fourth position-detecting sensor adjacent said withdrawal straightener to detect substantially orthogonally to a direction of detection of at least one of the first, second and third position-detecting sensors; and monitoring an elevational position of said cast strand using said fourth sensor as casting proceeds.

27. The method of continuously casting steel slabs of claim 26 where monitoring of said elevation position is accomplished by detecting an elevation location of a first broad side of said cast strand.

28. The method of continuously casting steel slabs of claim 21 where monitoring of each of said lateral positions is accomplished by detecting a first lateral location of a first narrow side of said cast strand and a second lateral location of a second opposite narrow side of said cast strand.

29. The method of continuously casting steel slabs of claim 21 where said position-detecting sensors comprise laser-based sensors.

30. A slab caster plant for producing cast slabs by continuous casting comprising:

(a) a vertically-oriented casting mold;

(b) optionally, a set of pinch rolls positioned downstream of said mold;

(c) a withdrawal straightener positioned downstream of said mold and optionally said set of pinch rolls;

(d) a cutting tool positioned downstream of said withdrawal straightener;

(e) a first pair of position-detecting sensors positioned adjacent entry of a cast strand into said withdrawal straightener and arranged to detect laterally with respect to said direction of casting;

(f) a second pair of position-detecting sensors positioned adjacent exit of the cast strand from said withdrawal straightener and arranged to detect laterally with respect to said direction of casting;

(g) a third pair of position-detecting sensors positioned adjacent an exit of said cutting tool and arranged to detect laterally with respect to said direction of casting; and (h) a computer-based system electrically connected to each of said position-detecting sensors and capable of controlling at least one correcting device to modify orientation of the cast strand along direction during casting to correct for twisting of the strand.

31. The slab caster plant for producing cast slabs by continuous casting of claim 30 where said position-detecting sensors include laser devices.

32. The slab caster plant for producing cast slabs by continuous casting of claim 30 where said computer-based system comprises:

a programmable logic controller; and a database management system.

33. The slab caster plant for producing cast slabs by continuous casting of claim 32 where said programmable logic controller (PLC) is capable of being programmed with automation software.

34. The slab caster plant for producing cast slabs by continuous casting of claim 30 where said computer-based system is capable of receiving data, corresponding to a detected position of a cast strand traveling through said caster plant, from at least one of said sensors and generating at least one control signal in response to said data to control at least one correcting device.

35. The slab caster plant for producing cast slabs by continuous casting of claim 30 where said computer-based system is capable of receiving data, corresponding to a detected position of a cast strand traveling through said caster plant, from at least one of said sensors and generating at least one feed-forward control signal and at least one feedback control signal in response to said data to control said correcting device.

36. The slab caster plant for producing cast slabs by continuous casting of claim 34 where the correcting device is capable of adjusting one or more of mold taper of said casting mold, roll force or pressure profile of said withdrawal straightener, tilt of said withdrawal straightener, tilt of said set of pinch rolls, cooling spray of said slab caster, drive speed of said set of pinch rolls, and drive speed of said withdrawal straightener and is capable of being controlled in response to said at least one control signal.

37. The slab caster plant for producing cast slabs by continuous casting of claim 35 where the correcting device is capable of adjusting one or more of mold taper of said casting mold, roll force or pressure profile of said withdrawal straightener, tilt of said withdrawal straightener, tilt of said set of pinch rolls, cooling spray of said slab caster, drive speed of said set of pinch rolls, and drive speed of said withdrawal straightener and is capable of being controlled in response to said at least one feed-forward control signal and said at least one feedback control signal.

38. The slab caster plant for producing cast slabs by continuous casting of claim 32 where said programmable logic controller is capable of receiving data, corresponding to a detected position of a cast strand traveling through said caster plant, from at least one of said sensors and transmitting said data to said database management system, and where said database management system is capable of storing said data and associating said data with other data received from other sensors.

39. The slab caster plant for producing cast slabs by continuous casting of claim 32 where said programmable logic controller (PLC) is capable of receiving stored data, corresponding to detected positions of a cast strand traveling through said caster plant, from said database management system, and processing said data to generate at least one control signal in response to said data to control at least one correcting device.

40. The metal caster plant for producing cast slabs by continuous casting of claim 30 further comprising a fourth position-detecting sensor positioned adjacent said withdrawal straightener and optionally said set of pinch rolls, and arranged along said direction of casting to detect substantially orthogonal to a direction of detection of at least one of the lateral detecting sensors.

41. The slab caster plant for producing cast slabs by continuous casting of claim 40 where said computer-based system is capable of receiving data, corresponding to a detected position of a cast strand traveling through said caster plant, from at least one of said sensors and generating at least one control signal in response to said data to control at least one correcting device.

42. The slab caster plant for producing cast slabs by continuous casting of claim 41 where the correcting device is capable of adjusting one or more of mold taper of said mold, roll force or pressure profile of said withdrawal straightener, tilt of said withdrawal straightener, tilt of said set of pinch rolls, cooling spray of said slab caster, drive speed of said set of pinch rolls, and drive speed of said withdrawal straightener and is capable of being controlled in response to said at least one control signal.

* * * * *